US008898847B2

(12) United States Patent
Farrell

(10) Patent No.: US 8,898,847 B2
(45) Date of Patent: Dec. 2, 2014

(54) BUCKET ARRANGEMENT AND METHOD OF USING THE SAME

(76) Inventor: Christopher P. Farrell, Orange, CT (US)

( * ) Notice: Subject to any disclaimer, the term of this patent is extended or adjusted under 35 U.S.C. 154(b) by 1429 days.

(21) Appl. No.: 11/884,626

(22) PCT Filed: Jan. 25, 2006

(86) PCT No.: PCT/US2006/002551

§ 371 (c)(1),
(2), (4) Date: Aug. 16, 2007

(87) PCT Pub. No.: WO2006/088617

PCT Pub. Date: Aug. 24, 2006

(65) Prior Publication Data

US 2008/0257384 A1 Oct. 23, 2008

Related U.S. Application Data

(60) Provisional application No. 60/653,882, filed on Feb. 16, 2005.

(51) Int. Cl.

| | |
|---|---|
| ***A46B 11/00*** | (2006.01) |
| ***A47L 17/00*** | (2006.01) |
| ***A47L 17/02*** | (2006.01) |
| ***A47L 21/00*** | (2006.01) |
| ***B08B 1/00*** | (2006.01) |
| ***B08B 3/04*** | (2006.01) |

(52) U.S. Cl.
CPC .... *B08B 3/04* (2013.01); *B08B 1/00* (2013.01)
USPC ..... 15/104.92; 15/105; 15/106; 15/114; 15/118

(58) Field of Classification Search
USPC ..... 15/21.1, 104.92, 146, 160, 244.1; 134/6
See application file for complete search history.

(56) References Cited

U.S. PATENT DOCUMENTS

| | | | | |
|---|---|---|---|---|
| 3,380,095 | A * | 4/1968 | Piper, Jr. | 15/97.1 |
| 3,913,165 | A * | 10/1975 | Behnk | 15/244.1 |
| 4,734,952 | A * | 4/1988 | Parchment et al. | 15/104.92 |
| 4,872,235 | A * | 10/1989 | Nielsen | 15/104.92 |
| 5,555,586 | A * | 9/1996 | Dorrich et al. | 15/21.2 |
| 5,638,567 | A * | 6/1997 | Danyluk | 15/21.2 |
| 6,991,829 | B2 * | 1/2006 | Bergman | 427/429 |
| 7,200,891 | B1 * | 4/2007 | McCulloch et al. | 15/104.92 |

* cited by examiner

*Primary Examiner* — Monica Carter
*Assistant Examiner* — Stephanie Berry
(74) *Attorney, Agent, or Firm* — Carmody Torrance Sandak & Hennessey LLP

(57) ABSTRACT

An improved apparatus and a method of using the apparatus for cleaning tools, utensils, and other objects. The apparatus comprises a container, a first wiping element that is submerged in a liquid in the container capable of removing undesirable material from at least a portion of the object and a second wiping element mountable to the container that is capable of removing excess moisture from the object. The object undergoes at least a two-step wiping comprising a first wiping against the first wiping element while submerged in the liquid and a second wiping against the second wiping element after being at least partially removed from the liquid. The apparatus of the invention reduces the potential for serious injuries from cuts or abrasions from contact with the objects and is more sanitary than systems currently used in the prior art. The apparatus of the invention may also be easily disassembled for cleaning.

19 Claims, 11 Drawing Sheets

BUCKET ARRANGEMENT AND METHOD OF USING THE SAME

CROSS REFERENCE TO RELATED APPLICATIONS

This application is a National Stage of International Application No. PCT/US2006/002551, filed Jan. 25, 2006, which claims the benefit of U.S. Provisional Application No. 60/653,882 filed Feb. 16, 2005, the subject matter of which is herein incorporated by reference in its entirety.

FIELD OF THE INVENTION

The invention is directed to an improved system for cleaning objects, such as tools and utensils, that reduces the potential for injury from serious cuts and abrasions and is more sanitary than systems used in the prior art.

BACKGROUND OF THE INVENTION

There is a need for a universally accepted sanitation method and apparatus for cleaning and disinfecting objects, such as knives and other culinary tools and utensils at for example, a culinary workstation that can comply with various Federal, state, and local standards governing the restaurant and food service or other applicable industry.

Currently, most culinary tool and utensils are cleaned by wiping them with a cloth that has been immersed in a disinfecting solution. As a result, there is a potential problem with food safety when a soiled rag is left in the disinfecting solution and is then used to wipe clean the culinary tools and utensils that are then used to prepare food. In addition, there is a potential safety hazard to culinary or other personnel, when a person wipes a tool or utensil clean with a wet towel, which increases his chances of a serious cut or abrasion from sharp surface(s). The most common disability claim in the food service industry is cuts, resulting in lost time and productivity and in higher worker's compensation rates. Finally, there is a cost concern due to the need for frequent changing of laundry service side towels for wet wiping culinary tools and utensils and for towels needed for drying such tools and utensils. Although single-use towels may also be used, this is a moderately expensive alternative.

In addition, while the focus of this application is on the cleaning and sanitizing of culinary instruments at a culinary workstation in restaurant or other food service location, it is believed that the apparatus and method of the invention are usable in other environments where tools, utensils, and implements need to be safely and efficiently cleaned and disinfected without danger to the user. Such environments may include home culinary and baking use, and medical and dental implement cleaning, as well as in barber, pedicure, manicure and cosmetical shops and offices for cleaning hand implements for treatment of the hair, skin and/or body. These hand implements generally comprise brushes, scissors, combs, pinzers, knives, etc., as well as special devices for tattooing of the skin.

U.S. Pat. No. 4,872,235 to Nielsen attempts to address the problem of increased risk of infection from contaminated implements in medical and dental applications by the use of a receptacle with mechanical cleaning means (e.g. brushes, lamellas or foam pads) disposed below the liquid surface in the receptacle to avoid inadvertent spattering of contaminated substances. However, the apparatus described in Nielsen simply cleans debris from contaminated implements, which are then sterilized in an autoclave, and does not provide a means for wiping excess fluid from the implements so that they may be immediately reused. Likewise, U.S. Pat. No. 5,652,993 to Kreyer describes a knife cleaner for cleaning opposing surfaces of a knife or other elongated objects between two opposably mounted brush means. However, Kreyer does not provide an apparatus that can quickly and easily be disassembled and cleaned and sanitized.

Thus, there remains a need in the art for an improved apparatus that can be used to safely clean tools, utensils, and other objects in various environments and that can quickly and easily be disassembled for cleaning and/or disinfecting.

The present invention attempts to solve these and other problems of the prior art by the use of an apparatus that can safely and efficiently clean objects, such as culinary tools and utensils. The issue of health code violations can be resolved by providing an apparatus that can quickly and easily be disassembled and run through a high temperature dishwasher to be sanitized. Additional health code violations can be addressed by the use of a disposable wiping elements (e.g., brushes or sponges) mounted for quick and easy attachment, that can be replaced on a daily (or more frequent) basis. The health and safety of the culinary worker may be better protected because the hazard of wiping a sharp knife blade clean with a towel is eliminated by use of the present invention.

The apparatus and process of the invention also allows for the use of pre-portioned packets of sanitizing powder concentrate, which ensures the proper ratio of sanitizing solution to water and avoids waste from incorrectly measuring or spilling the sanitizing powder concentrate. Additional cost savings that may be realized by the replacement of expensive side towels and single use towels with the apparatus of the present invention.

SUMMARY OF THE INVENTION

It is an object of the present invention to provide an improved apparatus for cleaning objects, such as utensils and tools which provides a safer way for a consumer to clean such objects, tools and utensils.

It is another object of the present invention to provide an improved apparatus and method for cleaning objects, such as tools and utensils, which may be easily and efficiently manufactured and marketed.

It is another object of the present invention to provide an improved method and apparatus for cleaning objects, such as tools and utensils, which may be easily disassembled and cleaned.

It is yet another object of the present invention to provide a kit for cleaning objects, such as tools and utensils, that overcomes the deficiencies of the prior art and achieves the advantages set forth herein.

It is still another object of the present invention to provide an apparatus containing parts that may be reused or replaced depending on the needs of the user.

To that end, and generally speaking, a preferred embodiment of the present invention is directed to an improved apparatus and a method of using the apparatus for cleaning tools, utensils, and other objects, wherein the apparatus comprises a container within which a liquid can be placed, the apparatus comprising:

a first wiping element mountable in the interior of the container and positioned so that at least a portion of the first wiping element is capable of being submerged in the liquid when the liquid is placed into the container and at least a portion of the object is contactable with the first wiping element while said portion of the object is submerged in the liquid, wherein the first wiping element is capable of removing undesirable material from the portion of the object; and a second wiping element mountable to the container;

wherein the portion of the object can undergo at least a two-step wiping comprising a first wiping against the first wiping element while submerged in the liquid and a second wiping against the second wiping element after being at least partially removed from the liquid.

Another embodiment of the present invention is directed to a kit for cleaning objects, said kit comprising:

a) a container within which a liquid can be placed;

b) a first wiping element mountable in the interior of the container and positionable so that at least a portion of the first wiping element is capable of being submerged in the liquid when the liquid is placed into the container and at least a portion of the object is contactable with the first wiping element while said portion of the object is submerged in the liquid, wherein the first wiping element is capable of removing undesirable material from the portion of the object;

c) a second wiping element, mountable to the container, for removing excess liquid from the portion of the object; and d) a cleaning solution concentrate that is usable for cleaning the objects, wherein said cleaning solution concentrate is dilutable in the container when a solvent is added thereto.

BRIEF DESCRIPTION OF THE FIGURES

Identical reference numerals in the figures are intended to indicate like features, although not every feature in every figure may be called out with a reference numeral.

DETAILED DESCRIPTION OF THE INVENTION

The present invention is directed to an improved apparatus for cleaning objects, such as knives at a culinary workstation (by means of example and not limitation). The improved apparatus of the invention reduces the potential for serious injuries from cuts or abrasions from contact with the object because the first wiping element or brush (and not a cleaning rag) is used to remove debris from the utensil. The system is also more sanitary than systems of the prior art as the correct dilution of an anti-bacterial or other cleaning solution can be easily prepared.

In a specific embodiment of the present invention the apparatus comprises a container within which a liquid can be placed, the apparatus comprising:

a first wiping element mountable in the interior of the container and positioned so that at least a portion of the first wiping element is capable of being submerged in the liquid when the liquid is placed into the container and at least a portion of the object is contactable with the first wiping element while said portion of the object is submerged in the liquid, wherein the first wiping element is capable of removing undesirable material from the portion of the object; and a second wiping element mountable to the container;

wherein the portion of the object can undergo at least a two-step wiping comprising a first wiping against the first wiping element while submerged in the liquid and a second wiping against the second wiping element after being at least partially removed from the liquid.

Figure 1:
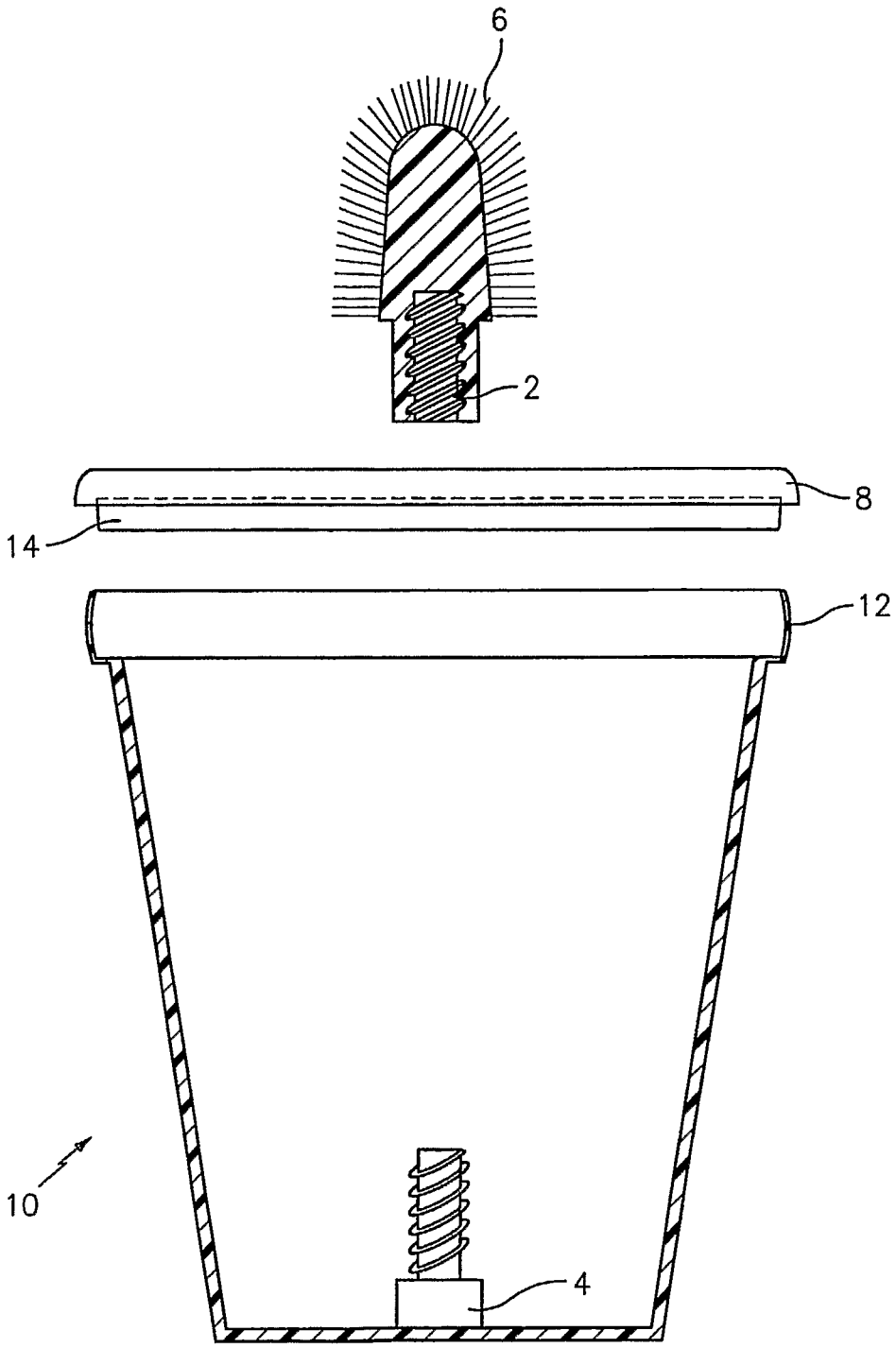
FIG. 1 is a side view of the first embodiment of the invention.

As depicted in FIG. 1, in a preferred embodiment, the container 10 may be a bucket. While the dimensions of the container 10 are not critical, it preferable that the depth of the container 10 be sufficient to receive a significant portion of the tool, utensil, or object to be cleaned and especially that the depth of the container 10 be sufficient so that the soiled portion of the tool, utensil, or object may be immersed fully therein. Therefore, the container 10 preferably has a height of between about 4 and about 20 inches, depending on the type of tools or instruments being cleaned, more preferably a height of between about 4 and about 12 inches. The container 10 preferably has a diameter (or width) of between about 6 and about 15 inches, more preferably between about 9 and about 12 inches. When the container is intended to be used at a culinary workstation, the container preferably has a height of about 10 to about 12 inches and a diameter (or width) of about 9 to about 10 inches. The container 10 may be constructed of injection-molded plastic as would be well known to those skilled in the art.

In one embodiment, as depicted in FIG. 1, the container 10 includes a mount 4 positioned on an inside surface of the bottom of the container 10 for coupling the first wiping element 6 to the mount. In a preferred embodiment, the first wiping element 6 is a dense brush. Various means can be used for coupling the first wiping element 6 to the mount 4, including threaded screw-type, twist lock, quick release coupler, bayonet-type, interlocking clamp, wire hose clamp, plug-in, ball socket, socket and plug, coupling socket, quick connect/slow-disconnect nut and bolt, and the like. In a preferred embodiment, the mount 4 is a molded male (or female) screw base fitting and the first wiping element 6 contains a female (or male) receptacle 2 to couple the first wiping element 6 to the mount 4. In the illustrations, the coupling is achieved by mating threading of the male and female components. The first wiping element (brush) 6 is preferably mounted so that the entire brush 6 is beneath the surface of the liquid when the container is filled. In a preferred embodiment, the height of the brush 6 when mounted on the mount 4, is between about 6 and about 8 inches, but this will depend on the type of tools and utensils being cleaned.

Figure 2:
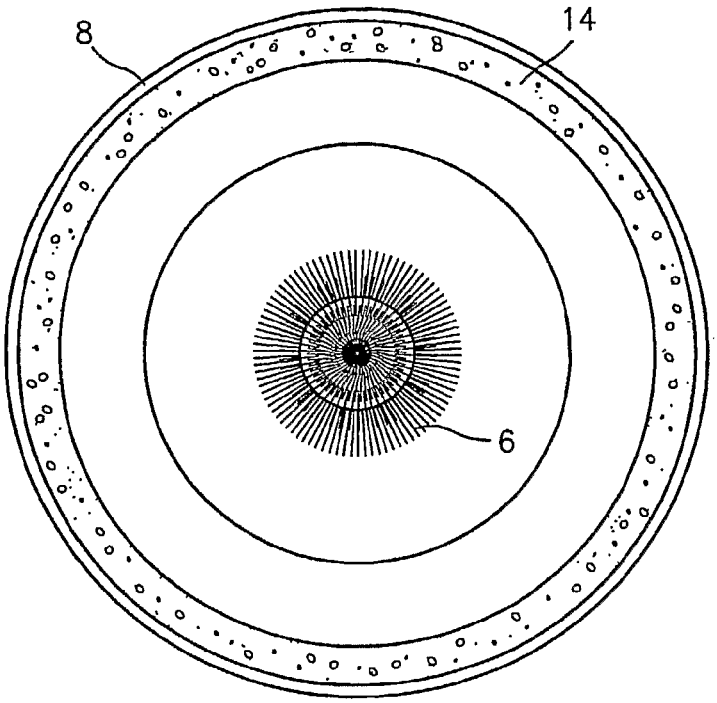
FIG. 2 is a top view of the first embodiment of the invention.
Figure 3:
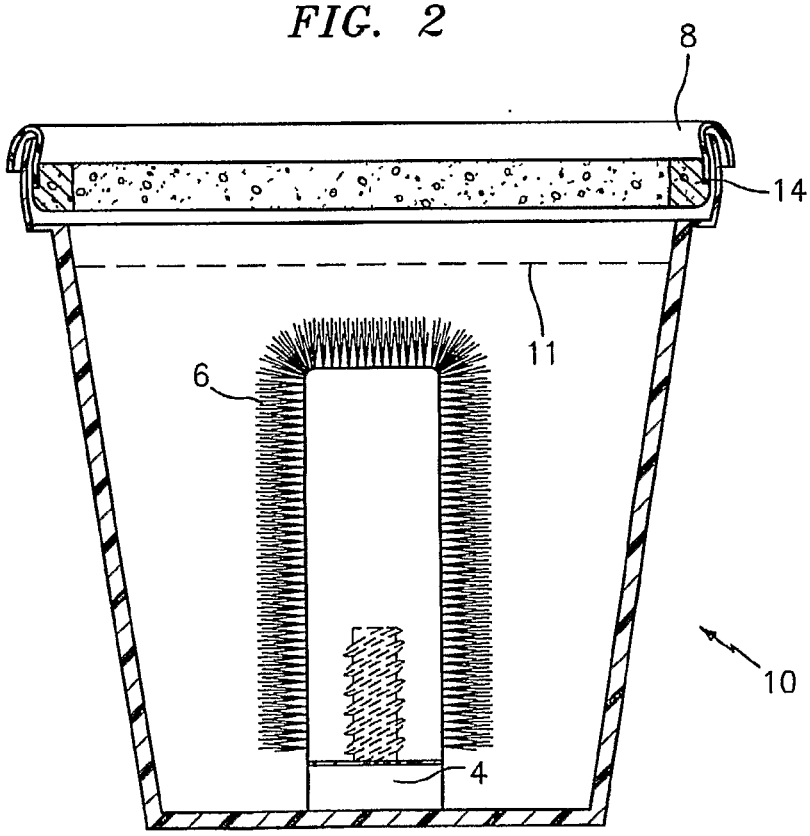
FIG. 3 is another view of the first embodiment of the invention.

In the embodiment depicted in FIGS. 1-3, the second wiping element 14 is mounted on an O-ring 8 that is couplable to the top opening of the container 10. The second wiping element may be selected from a group comprised of natural and synthetic sponges, brushes, foams, or cloth or disposable wipes and is generally chosen based on the environment in which it is being used and to comply with applicable regulations. In a preferred embodiment, the top opening is a rim 12 surrounding a top edge of the container 10. The second wiping element 14 is typically selected from a group comprised of brushes and anti-microbial sponges, although other wiping elements would also be known to those skilled in the art. In a preferred embodiment, the second wiping element 14 is a brush.

Figure 4A:
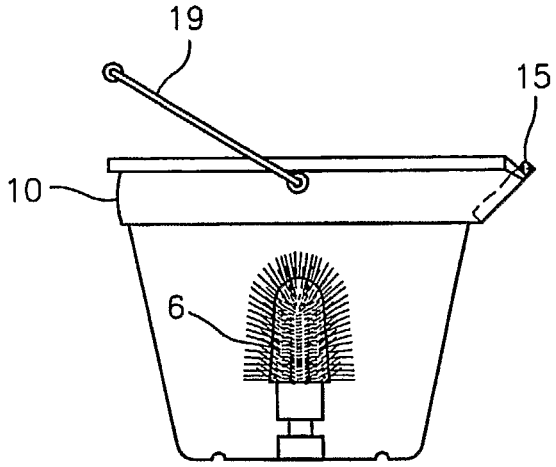
FIG. 4A, 4B, 4C, 4D depict alternative configurations of the first embodiment of the invention.
Figure 4B:
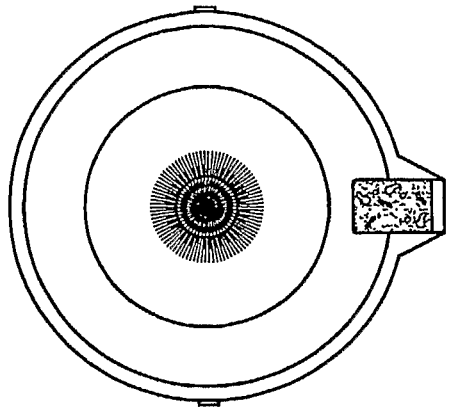
Figure 4C:
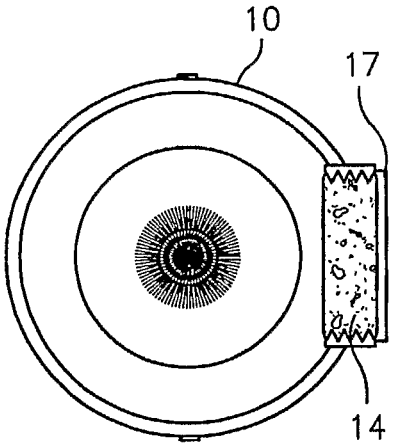
Figure 4D:
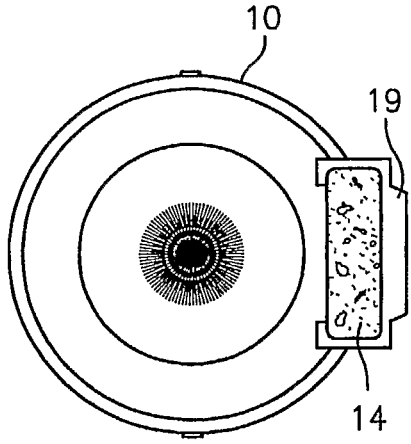

In another embodiment depicted in FIGS. 4A and 4B, the second wiping element 15 is set in at an angle in the container so that excess liquid can be returned to the container 10. In this embodiment, the means for holding the second wiping element in place can be a set of grabbing claws or the container 10 itself can be molded to accept the second wiping element 15. Container 10 may comprise a handle 19. In yet alternative arrangements as shown in FIGS. 4C and 4D, the second wiping element may be mounted along or proximate the rim of the container and secured thereto using grabbing claws 17 (FIG. 4C) or a holder 17*a* (FIG. 4D), which may be a clip-on or built-in holder on container 10. Still further, multiple (and separate) second wiping elements may be positioned on (e.g. on opposite sides of) the rim to accommodate (e.g.) multiple users sharing a single container 10, such as in a multiple workstation environment.

The container 10 may also be marked with a fill line 11 to indicate a desired level of liquid in the container when the container is filled with the liquid.

Also while it is generally preferable the that container be cylindrical, other container shapes may also be used so long as it is possible to couple the brush and the wiping element to the container in the manner described and claimed herein. If a non-cylindrical container is used, the second wiping element 14 is mounted on an appropriate mounting means so that the second wiping element 14 is mountable on the container 10.

In one embodiment, the container is filled with a cleaning solution that cleans and sanitizes the tools or utensils as they are inserted into the container. In a preferred embodiment, an anti-bacterial cleaning solution is used, such as a chlorinated detergent sanitizer. The anti-bacterial cleaning solution may be prepared from a powdered detergent concentrate that is mixed with a solvent (i.e., water) to the proper dilution. One suitable concentrate is a sodium hypochlorite phosphate concentrate, manufactured by Ecolab, Inc. of St. Paul, Minn., under the tradename Mikro-chlor®.

The tools or utensils to be cleaned are inserted into the cleaning solution contained in the container 10 so that the utensils abrasively contact the first wiping element 6. Thereafter, the tools or utensils are wiped on the second wiping element 14 to remove excess cleaning solution.

The present invention is also directed to a kit for cleaning tools and utensils that may be purchased by the end user for use. In a preferred embodiment, the kit comprises:

a) a container within which a liquid can be placed;

b) a first wiping element mountable in the interior of the container and positionable so that at least a portion of the first wiping element is capable of being submerged in the liquid when the liquid is placed into the container and at least a portion of the object is contactable with the first wiping element while said portion of the object is submerged in the liquid, wherein the first wiping element is capable of removing undesirable material from the portion of the object;

c) a second wiping element, mountable to the container, for removing excess liquid from the portion of the object; and d) a cleaning solution concentrate that is usable for cleaning the objects, wherein said cleaning solution concentrate is dilutable in the container when a solvent is added thereto.

As discussed above, the container 10 is preferably marked with a fill line to indicate a level of cleaning solution in the cylindrical container when the cleaning solution concentrate is diluted and the container is filled to the fill line with the solvent.

In the preferred embodiment, the first wiping element and the second wiping element are designed to be capable of being disassembled from the container, so that the first wiping element, second wiping element, and the container may be separately cleaned and disinfected. In addition, the present invention also contemplates the use of replacement parts that may be purchased if the original part becomes worn or broken or to comply with pertinent Federal, state and local regulations. In particular, the present invention contemplates the use of replacement brushes and wiping elements that may be separately purchasable.

The present invention is also directed to a method of cleaning objects and removing undesirable material thereon, comprising a container within which a liquid can be placed, a first wiping element mountable in the interior of the container and positionable so that at least a portion of the first wiping element is capable of being submerged in the liquid when liquid is placed in the container and at least a portion of the object is contactable with the first wiping element while said portion of the object is submerged in the liquid, and a second wiping element mountable to the container. In a preferred embodiment, the method comprises the steps of:

a) inserting the object to be cleaned into the liquid and abrasively contacting at least a portion of the object with the first wiping element to remove undesirable material from the portion of the object; and b) thereafter, wiping the portion of the object on the second wiping element to remove excess liquid from the at least the portion of the object, wherein the second wiping element remains mounted to the container while step (b) is being performed.

The second wiping element is preferably disposed in the container so that at least a portion of the second wiping element remains above the surface of the cleaning solution in the container.

The method also includes the step of adding cleaning solution concentrate to the container and then filling the container with solvent to a fill line in the container that indicates a level of cleaning solution.

Various tools and utensils may be cleaned by the method of the present invention, including knives, scissors, eating utensils, culinary instruments, surgical tools, medical hand instruments, dental hand instruments, personal grooming implements, and combinations of one or more of the foregoing. Other utensils and tools may also be cleaned in a similar fashion and would be known to those skilled in the art. The cleaning solution can be chosen depending on the type of object being cleaned.

Figure 6:
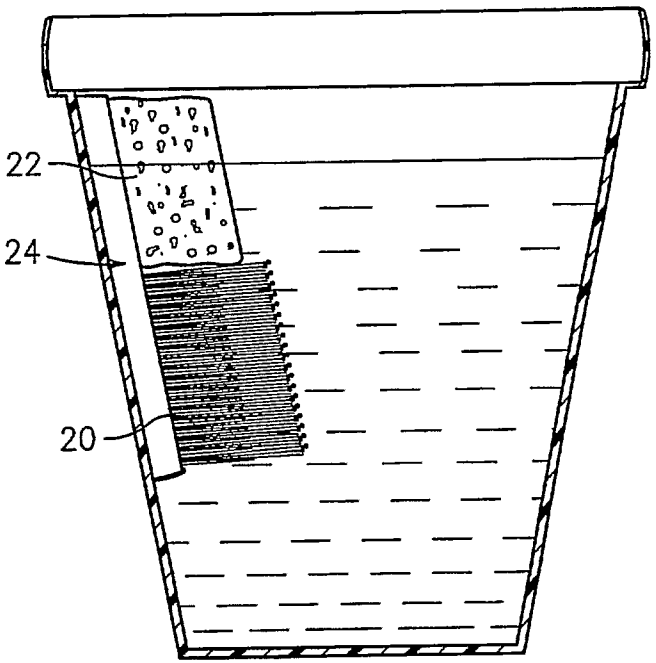
FIG. 6 is a side view of the second embodiment of the invention.
Figure 5:
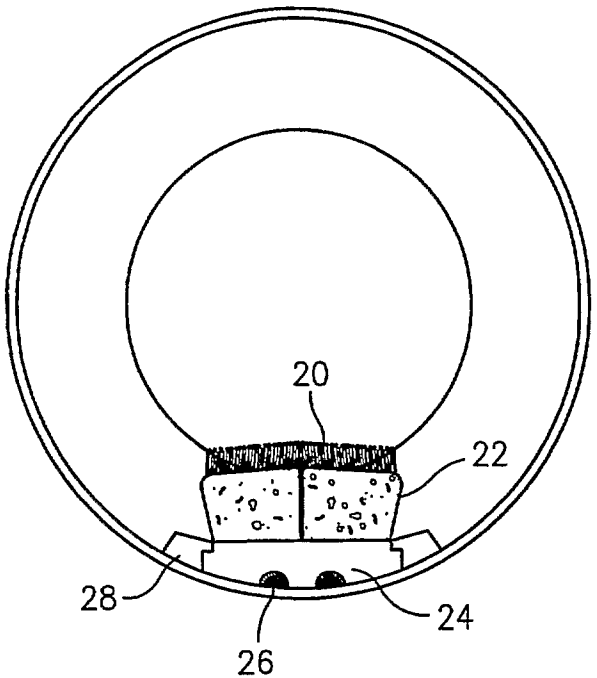
FIG. 5 is a top view of a second embodiment of the invention.

FIGS. 5 and 6 depict a second embodiment of the present invention, in which the first wiping element 20 and the second wiping element 22 are mounted on a side of the container 10. As best seen in FIG. 6, the first wiping element 20 and second wiping element 22 can be mounted on a hard plastic base 24 and are then slidably engaged with the container 10 via a double nub sliding rail track 26 and between a molded slide rail element 28. Other means of mounting the first wiping element 20 and the second wiping element 22 would also be known to those skilled in the art. In this embodiment, the first wiping element 20 is entirely submerged in the liquid (i.e., cleaning solution) when the container 10 is filled and the second wiping element 22 has at least a portion that extends above the surface of the liquid in the container 10.

Figure 8:
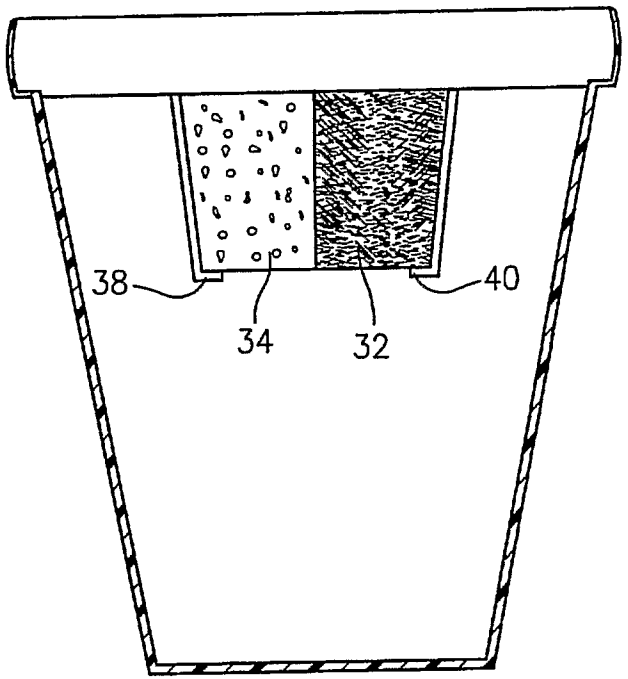
FIG. 8 is a side view of the third embodiment of the invention.
Figure 7:
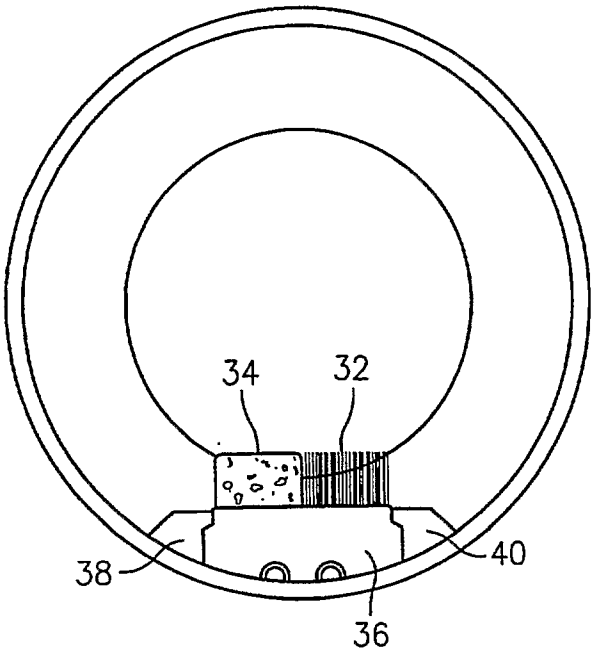
FIG. 7 is a top view of a third embodiment of the invention.
Figure 9C:
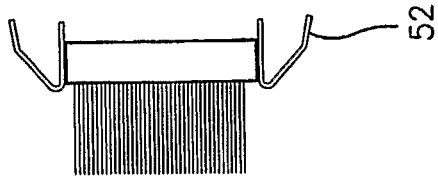
FIGS. 9B and 9C depict the securing clips that are usable in the fourth embodiment of the invention.
Figure 9B:
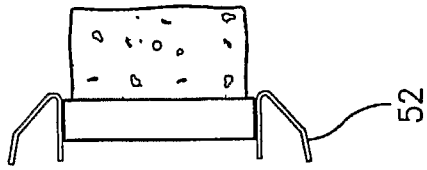
Figure 9A:
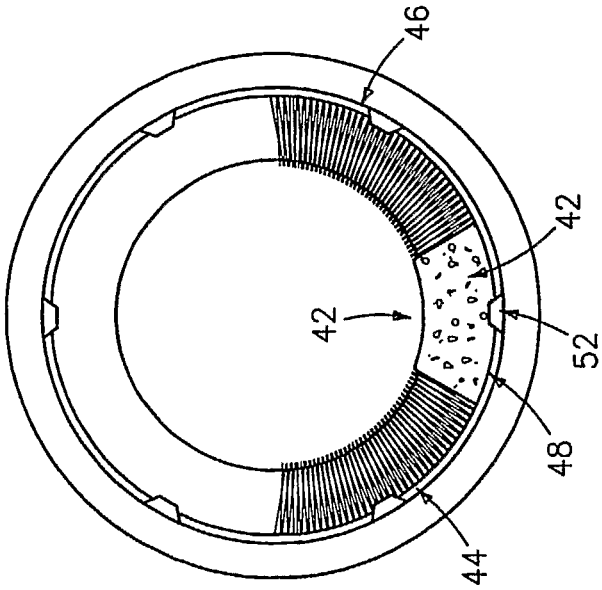
FIG. 9A is a top view of a fourth embodiment of the invention.
Figure 11:
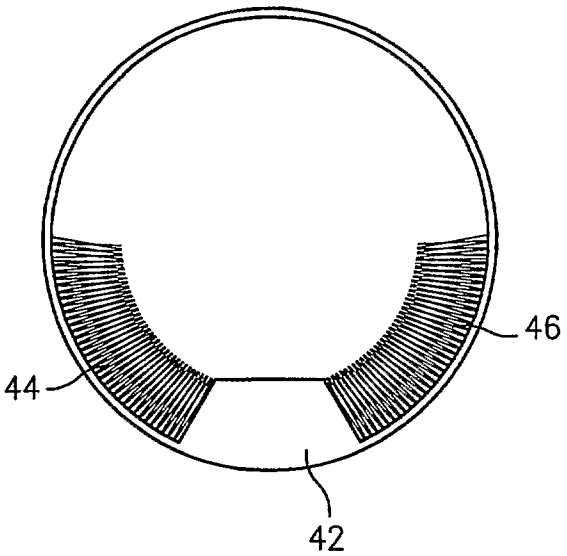
FIG. 11 is a view of a replacement ring that is usable with the apparatus of the invention.
Figure 10:
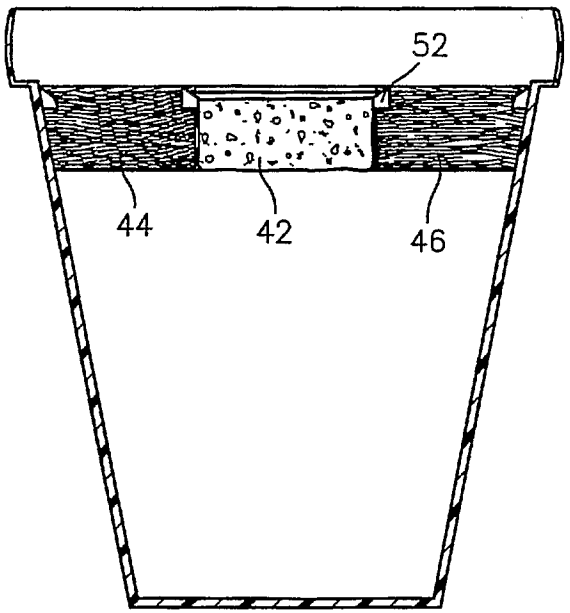
FIG. 10 is a side view of the fourth embodiment of the invention.

FIGS. 7 and 8 depict a third embodiment of the present invention, in which the first wiping element 32 and the second wiping element 34 are mounted adjacent to each other on a side of the container 10. As best seen in FIG. 7, the first wiping element 32 and the second wiping element 34 can be mounted on a one-piece hard plastic base 36 and are then slidably engaged with the container 10 via molded slide rails 38 and 40.

FIGS. 9A-9C, 10, and 11 depict a fourth embodiment of the present invention, in which the second wiping element 42 is disposed between two first wiping elements 44 and 46 and the two first wiping elements 44 and 46 and the second wiping element 42 are mounted on an O-ring 48 that can be disposed on a rim 50 of the container 10. The mounting means are typically a plurality of molded securing clips 52, although other mounting means would also be known to those skilled in the art.

Figure 12:
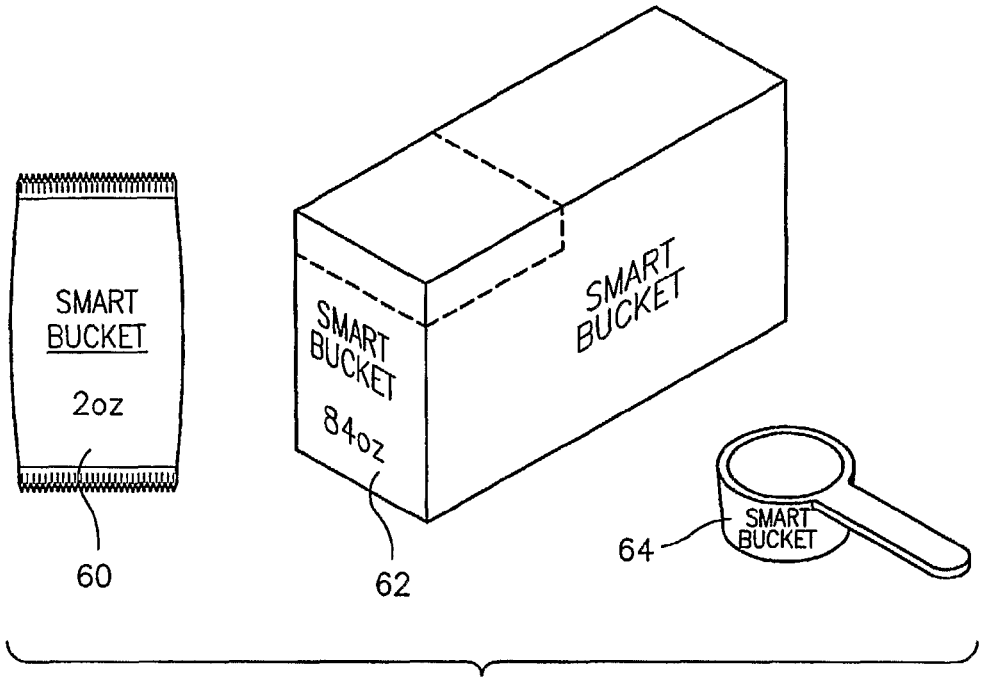
FIG. 12 is a view of a sanitizing solution that is usable with the apparatus of the invention.

FIG. 12 is a view of a sanitizing solution that is usable with the system of the invention. As seen in FIG. 12, the sanitizing solution may be made available in pre-measured portion packets 60 in order to avoid waste. If a powdered detergent such as Mikro-Chlor® is used, the detergent packets may be portioned into 2-ounce packets for the container described above for use at a culinary workstation. Other pre-portioned packets 60 may be prepared for different size buckets and different detergent solutions. In the alternative, the sanitizing solution may be provided in bulk 62 with a scoop 64 that allows for the correct portion of sanitizing solution to be portioned out.

Figure 13:
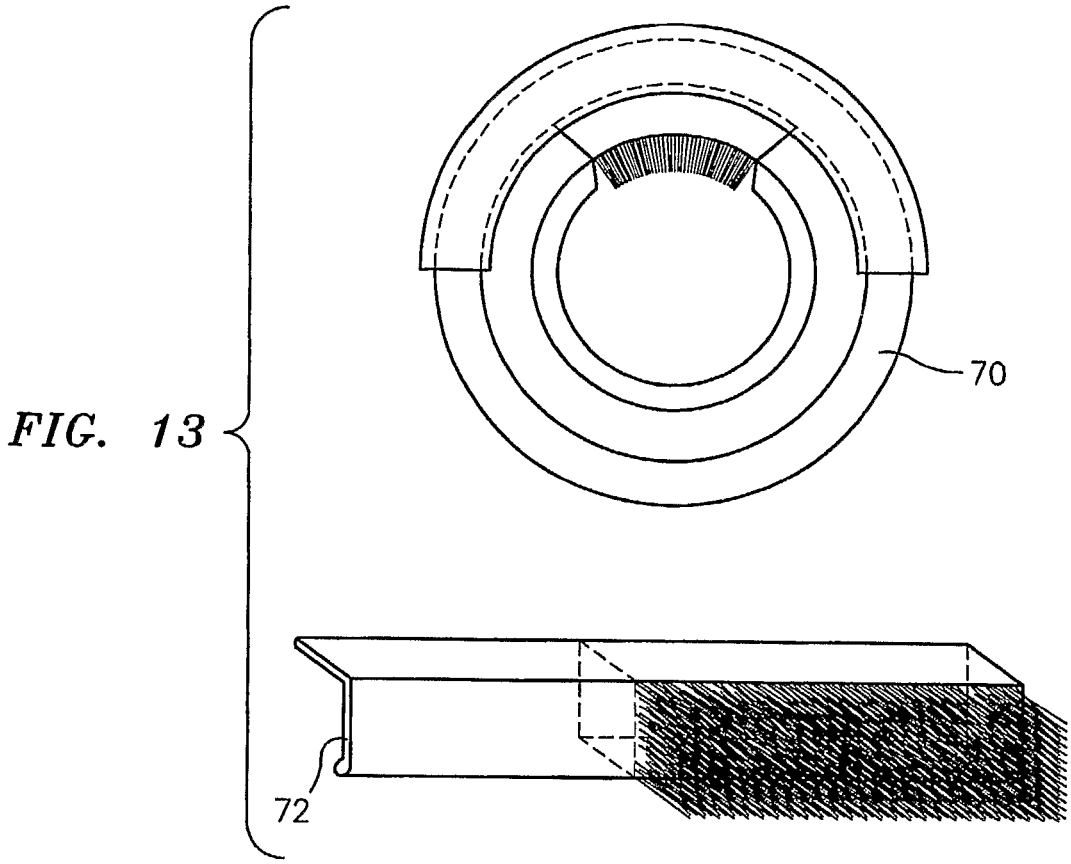
FIG. 13 is a view of a variation of a replacement ring that is usable with the apparatus of the invention.
Figure 14:
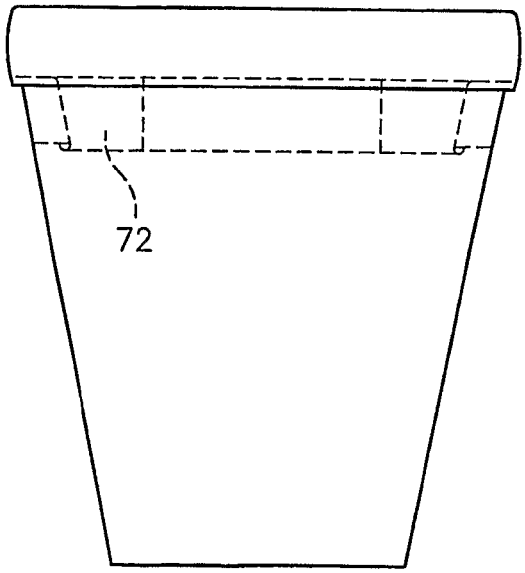
FIG. 14 is a side view of another embodiment of the invention.

As depicted in FIGS. 13 and 14, the apparatus of the invention may further comprise a hollow ring 70 with a lip 72 that can be mounted on a rim of the container 10 that is designed to catch debris.

Figure 15:
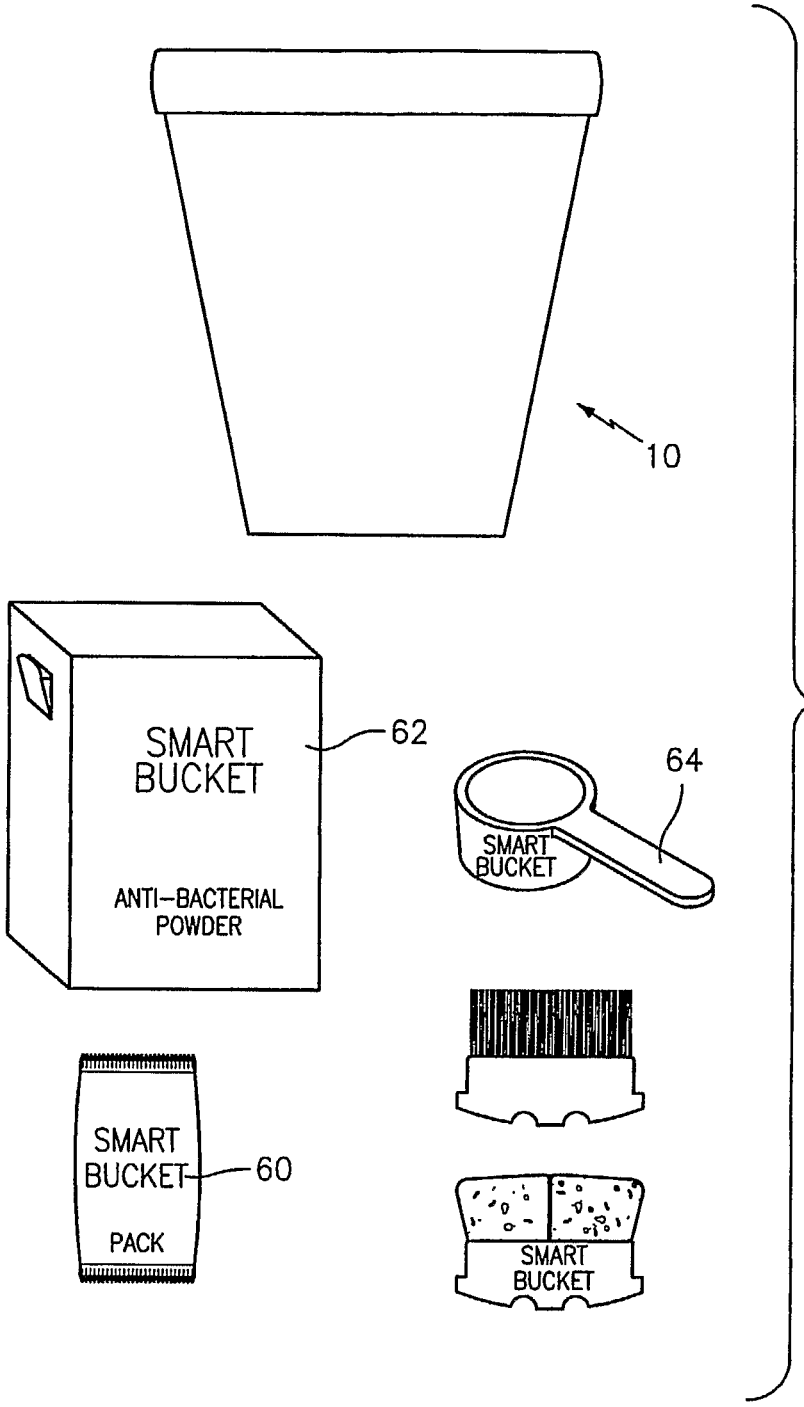
FIG. 15 is a view of a kit of the invention comprising a bucket, brush refill, wiping element refill and anti-bacterial concentrate.
Figure 16:
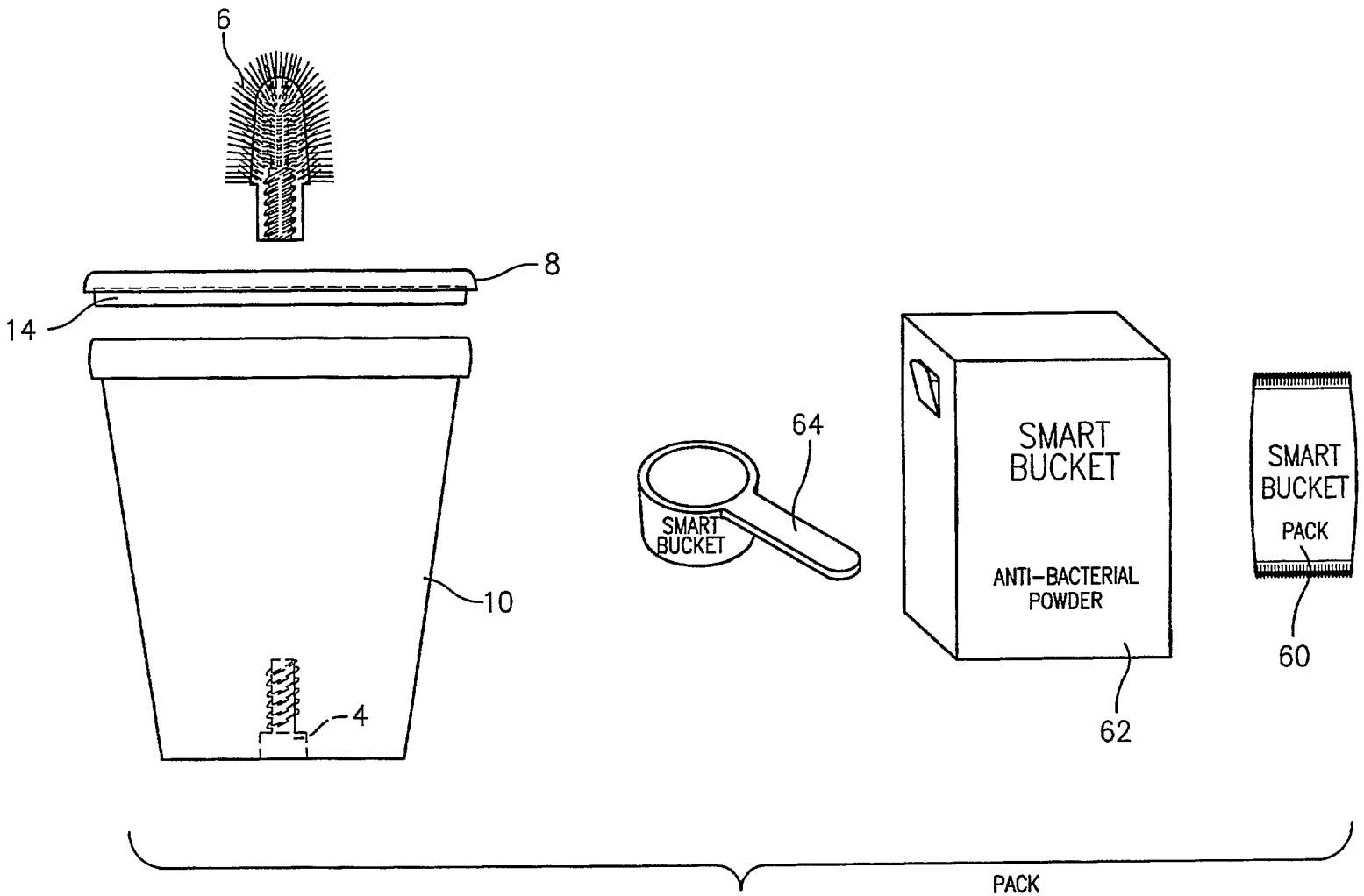
FIG. 16 is a view of another kit of the invention comprising a bucket, brush refill, an O-ring type wiping element refill, and anti-bacterial concentrate.

FIGS. 15 and 16 depict examples of various non-limiting kits that can be prepared in accordance with the present invention. As discussed above, in a preferred embodiment, the kits comprise the container 10, a first wiping element, a second wiping element, and a cleaning solution concentrate. The first wiping element and the second wiping element can be any of the various wiping elements described in the embodiments above. FIG. 15 depicts a kit containing a bucket, a first wiping element (brush refill), a second wiping element refill and anti-bacterial concentrate. FIG. 16 depicts a kit according to a first embodiment of the invention containing a bucket, an O-ring/second wiping element refill, a first wiping element (brush refill), and anti-bacterial concentrate.

It can thus be seen that the present invention provides for significant advancements over the prior art for providing a safe and effective means for cleaning and disinfecting tools and utensils. The present invention also provides for advancements over the prior art for providing an improved apparatus that can easily be disassembled and cleaned so that it may be reused.

It is also to be understood that the following claims are intended to cover all of the generic and specific features of the invention described herein and all statements of the scope of the invention which as a matter of language might fall therebetween.

What is claimed is:

1. An apparatus for cleaning an object, wherein the apparatus comprises a container capable of holding a liquid, the apparatus comprising:

a first wiping element mountable in the interior of the container and positioned so that at least a portion of the first wiping element is capable of being submerged in the liquid when the liquid is placed into the container and at least a portion of the object is contactable with the first wiping element while said portion of the object is submerged in the liquid, wherein the first wiping element is capable of removing undesirable material from the portion of the object; and a second wiping element mounted to the container; at an upper edge of a rim encircling a peripheral edge of the container, wherein at least a portion of the rim to which the second wiping element is mounted is angled, whereby excess liquid can be returned to the container;

wherein the portion of the object can undergo at least a two-step wiping comprising a first wiping against the first wiping element while submerged in the liquid and a second wiping against the second wiping element after being at least partially removed from the liquid, and wherein the position of the second wiping element does not change relative to the position of the first wiping element during either insertion of the portion of the object into the container or removal of the portion of the object from the container.

2. The apparatus according to claim 1, wherein at least a portion of the second wiping element is not submerged in the liquid in the container.

3. The apparatus according to claim 1, wherein the second wiping element is spaced apart from the first wiping element.

4. The apparatus according to claim 1, wherein the container is a bucket.

5. The apparatus according to claim 1, wherein the first wiping element is mounted in the container by coupling the first wiping element to a mount positioned in the container.

6. The apparatus according to claim 5, wherein the first wiping element is a brush.

7. The apparatus according to claim 1, wherein the second wiping element is a brush or an anti-microbial sponge.

8. The apparatus according to claim 1, wherein at least one of the first wiping element and the second wiping element is removably mounted to the container.

9. The apparatus according to claim 1, wherein the container is marked with a fill line to indicate a level of liquid in the container when the container is filled with said liquid.

10. A cylindrical bucket having an open top, wherein a diameter of the open top of the bucket is at least as large as a diameter of the bottom of the bucket, wherein the cylindrical bucket is capable of holding a liquid, the bucket comprising:

a first wiping element mountable in the interior of the bucket and positioned so that at least a portion of the first wiping element is capable of being submerged in the liquid when the liquid is placed into the bucket and at least a portion of an object to be cleaned is contactable with the first wiping element while said portion of the object is submerged in the liquid, wherein the first wiping element is capable of removing undesirable material from the portion of the object; and a second wiping element mounted to the bucket at a portion of an upper edge of a rim of the bucket;

wherein the portion of the object can undergo at least a two-step wiping comprising a first wiping against the first wiping element while submerged in the liquid and a second wiping against the second wiping element after being at least partially removed from the liquid, and wherein the position of the second wiping element does not change relative to the position of the first wiping element during either insertion of the portion of the object into the container or removal of the portion of the object from the container.

11. The apparatus according to claim 10, wherein at least the portion of the rim to which the second wiping element is mounted is angled, whereby excess liquid can be returned to the bucket.

12. A cylindrical bucket having an open top, wherein a diameter of the open top of the bucket is at least as large as a diameter of the bottom of the bucket, wherein the cylindrical bucket is capable of holding a liquid, the bucket comprising:

a first wiping element mountable on an inside surface of the bottom of the bucket and positioned so that at least a portion of the first wiping element is capable of being submerged in the liquid when the liquid is placed into the bucket and at least a portion of an object to be cleaned is contactable with the first wiping element while said portion of the object is submerged in the liquid, wherein the first wiping element is capable of removing undesirable material from the portion of the object; and a second wiping element mounted to the bucket at a portion of an upper edge of a rim encircling an outer edge of the open top of the bucket, wherein at least the portion of the rim to which the second wiping element is mounted is angled, whereby excess liquid can be returned to the bucket;

wherein the portion of the object can undergo at least a two-step wiping comprising a first wiping against the first wiping element while submerged in the liquid and a second wiping against the second wiping element after being at least partially removed from the liquid; and wherein the position of the second wiping element does not change relative to the position of the first wiping element during either insertion of the portion of the object into the container or removal of the portion of the object from the container.

13. The bucket according to claim 12, wherein the object is a culinary tool or utensil.

14. The bucket according to claim 12, wherein the first wiping element is a brush, wherein the brush is removably couplable to a mount positioned on the inside surface of the bottom of the bucket.

15. The bucket according to claim 12, wherein the bucket, including the portion of the rim that is angled, is injection molded in a one-piece construction.

16. The apparatus according to claim 8, wherein both the first wiping element and the second wiping elements are removably mounted to the container.

17. The apparatus according to claim 7, wherein the second wiping element is an anti-microbial sponge.

18. The apparatus according to claim 1, wherein the position of the second wiping element does not change relative to the position of the first wiping element during any of insertion of the portion object to be cleaned into the container, cleaning the portion of the object in the container, or removal of the portion of the object from the container.

19. The apparatus according to claim 1, wherein the container comprises an open top, wherein a diameter of the open top of the container is at least as large as a diameter of a bottom of the container.

* * * * *